United States Patent [19]

Kaplow et al.

[11] 4,326,898

[45] Apr. 27, 1982

[54] METHOD FOR FORMING MATERIAL SURFACES

[75] Inventors: Roy Kaplow, Newton; Carl J. Russo, Ipswich, both of Mass.

[73] Assignee: Massachusetts Institute of Technology, Cambridge, Mass.

[21] Appl. No.: 122,975

[22] Filed: Feb. 20, 1980

Related U.S. Application Data

[63] Continuation of Ser. No. 960,588, Nov. 13, 1978, abandoned, which is a continuation of Ser. No. 726,354, Sep. 24, 1976, abandoned.

[51] Int. Cl.[3] ..... C21D 1/48

[52] U.S. Cl. ..... 148/16.6; 148/20.3; 148/31.5; 204/177

[58] Field of Search ..... 148/4, 16.6, 15.5, 20.3, 148/175, 31.5; 204/37 R, 177, 192, ; 427/334; 960/588

[56] References Cited

U.S. PATENT DOCUMENTS

| | | | |
|---|---|---|---|
| 2,565,360 | 8/1951 | Dufilho | 148/16.6 |
| 2,784,639 | 3/1957 | Keenan et al. | 148/16.6 |
| 2,946,708 | 7/1960 | Berghaus et al. | 148/16.6 |
| 3,208,888 | 9/1965 | Ziegler et al. | 148/175 |
| 3,666,533 | 5/1972 | Arthur et al. | 148/175 |
| 3,900,636 | 9/1975 | Curry et al. | 148/4 |
| 3,925,116 | 12/1975 | Engel | 148/31.5 |

FOREIGN PATENT DOCUMENTS

| | | | |
|---|---|---|---|
| 2202015 | 7/1972 | Fed. Rep. of Germany | 148/4 |

OTHER PUBLICATIONS

J. Electrochem. Soc.; Solid State Science, Aug. 1967, vol. 114, No. 8, pp. 826–833.

*Primary Examiner*—John P. Sheehan

*Attorney, Agent, or Firm*—Arthur A. Smith, Jr.; Paul J. Cook

[57] ABSTRACT

Material surfaces are provided which maintain their characteristic properties over long periods and which resist degradation by the environment in which they are utilized. The surfaces are formed by exposing a surface of atomically clean material to a gas or liquid which interacts with the clean surface to form a composition having the properties desired and which is stable against degradation in the environment of use. The process is useful, for example, to render metals or metal alloys, such as iron or iron alloys, stable against oxidation by air by exposing the atomically clean surface to an ultra-pure nitrogen environment, prior to exposure to a degrading environment, such as air. A new oxidation-resistant iron surface composition also is provided which comprises body-centered iron structures including nitrogen atoms interstitially. This surface composition is essentially free of face-centered cubic iron-nitrogen structures and martensite iron-nitrogen structures as well as morphologies derived from the thermal decomposition of those structures.

5 Claims, No Drawings

METHOD FOR FORMING MATERIAL SURFACES

BACKGROUND OF THE INVENTION

The Government has rights in this invention pursuant to Contract No. GH-33635 and IPA-0010 awarded by the National Science Foundation.

This is a continuation of application Ser. No. 960,588 filed Nov. 13, 1978, now abandoned, which is a continuation of Ser. No. 726,354 filed Sept. 24, 1976, also abandoned.

This invention relates to a process for forming surfaces such as metal or ceramic surfaces which are essentially non-reactive with the liquid or gaseous medium in which the surface is utilized. More specifically, the present invention relates to a process for making such surfaces by forming an atomically clean surface and subjecting the surface to gaseous or liquid compositions that react with the surface to form a surface composition that is stable in the medium in which the surface is utilized.

The functions of a wide variety of surface phenomena such as catalytic activity, surface optical properties, resistance to corrosion, surface magnetic properties and surface electrical properties depend primarily upon the initial composition of the surface and upon the change in surface composition as a function of time due to reaction of the surface with the gaseous or liquid medium in which the surface is utilized. Metals, for example, do not normally react with nitrogen in ambient atmosphere. This is largely because the kinetics of oxidation are such that an oxide forms first and covers the surface. The metal nitride or absorbed nitrogen apparently does not form in significant concentrations or, if it does form, not in a manner that protects the metal in the air. The oxide rather than the nitride likely forms because the energy required to dissociate the $N_2$ triple bond is greater than that required to break the $O_2$ double bond. The ramifications of this fact are significant in metal corrosion and in catalytic activity utilizing metals or metal compounds. For example, with iron, the oxide layer initially formed in air does not prevent further and continued oxidation from occuring since the iron oxide layer is permeable to iron and/or oxygen. It is believed that an iron oxide monolayer forms in about 1 second at a pressure of $10^{-6}$ Torr. In contrast, iron laden with chemically absorbed nitrogen which occupies the interstitial spaces between the iron atoms inhibits oxidation of the iron to a significant degree even when formed at ambient conditions. Therefore, when it is desirable to prevent oxidation, it is undesirable to form an initial surface of iron oxide but desirable to form an initial surface of iron nitride and/or chemisorbed nitrogen.

At the present time, theories defining the mechanisms of catalysis utilizing metals or metal compound catalysts have been found, for the most part, to provide only a partial explanation of the role of the surface in catalysis. This is due, in part, to the fact that the metals are not pure but have surface compositions dependent upon their initial conditions of fabrication as well as the chemical conditions during use. Thus, for example, the reaction usually is being catalyzed by a metal in the form of an oxide or oxides in varying oxidation states or by some other uncharacterized surface compound formed in the working environment or by certain surface impurities or a combination of all or some of these. It would be desirable to provide catalysts having a uniform surface composition with a composition stable to the gaseous or liquid environment in which it is placed so that more uniform catalytic activity and selectivity could be achieved over extended time periods.

While corrosion resistance and catalytic activity are prime examples of surface phenomena which are dependent upon surface composition, other notable examples include optical properties such as reflectivity, emissivity and absorbtivity; and surface electrical properties which are utilized in the electronic industry including ceramic or semiconductor materials doped with any of several elements or compounds. Again, it would be desirable to provide surface compositions which are stable against degradation by their surrounding environment so that the desired surface properties can be maintained over extended periods of time.

In prior attempts to passivate surfaces by surface treatment methods, the material is cleaned in a reacting gas or liquid, such as an aqueous solution. However, after such treatments, the surface contains an absorbed layer of the cleaning agent. Furthermore, this layer formed during the so-called cleaning process often is subjected to subsequent contamination such as by oxidation beginning immediately upon removal from the aqueous bath.

SUMMARY OF THE INVENTION

According to this invention, a surface of a material is formed having the properties desired, e.g. surface optical properties, surface magnetic properties, surface electrical properties, catalytic properties, etc. and which is resistant to degradation by the gaseous or liquid environment in which it is subsequently utilized. An atomically clean surface of the material first is formed in an environment which can be an inert gas, a vacuum essentially free of gases or liquids that are deleteriously reactive with the material, or in the presence of a gas or liquid that interacts with the material to form a surface composition having the desired properties and having high stability against degradation by the environment in which the surface is to be utilized. Interaction of the surface with the gas or liquid can occur by chemical reaction, physical interaction such as absorption or by a combination of these mechanisms. When the surface is formed in an inert gas or in a vacuum, it is exposed subsequently to a gas or liquid or to a sequence of gases or liquids which interact therewith to form a surface composition having the desired properties and having the resistance to degradation by the gas or liquid environment in which the surface is to be utilized. This invention also provides a new oxidation-resistant iron surface composition which comprises body-centered iron structures including nitrogen atoms located interstitially. This surface composition is essentially free of face-centered cubic iron structures and martensite iron structures and of the structures derived from thermal decomposition of those structures.

DESCRIPTION OF SPECIFIC EMBODIMENTS

In accordance with this invention, a surface of a material is formed under conditions such that the material is atomically clean. An "atomically clean". surface is composed of atoms or molecules of essentially the same composition as the average composition of the base material without any additional contaminants. In practice this means a surface with less than about 5% and preferably less than about 1% surface impurity atoms or molecules on the surface. The exact concentration of impurity atoms or molecules allowable for an "atomically clean" surface depends upon the property under consideration, the nature of the impurity, temperature, pressure, surface morphology, etc. The atomically clean surface must be formed in an environment which is either nonreactive with the surface or, if reactive with the surface provides, upon reaction, the desired surface properties and renders it stable in the gas or liquid environment in which the surface is to be utilized. The atomically clean surface is formed by such means as removing the contaminated surface such as by grinding, exposing the surface to a plasma or machining in an inert atmosphere, spraying liquid as, for example, in the making of fine powders or by depositing a new pure surface on the contaminated surface such as by evaporating or sputtering a pure material onto the contaminated surface. When the atomically clean surface is formed in a vacuum, the pressure must be less than that which affords formation of a deleterious layer comprising the reaction product of the surface and the atmosphere. For example, when forming an atomically clean surface of iron, the base pressure in the system must be less than about $10^{-9}$ Torr, preferably less than about $10^{-10}$ Torr.

These pressures allow the surface to remain atomically clean for periods ranging from hours to days depending on the material and its preparation. Higher pressures result in correspondingly shorter periods where the sample remains clean. For example, a highly reactive polycrystalline metal film, e.g. iron, will remain atomically clean for less than 1 second at $10^{-6}$ Torr, but a single crystal of silicon will remain atomically clean for more than 10 times as long as iron at the same pressure.

When forming the atomically clean surface either in an inert atmosphere or in an atmosphere which provides the desired surface properties and which passivates the surface against degradation in the environment in which it is to be utilized, the concentration of impurities such as oxygen which react rapidly with the surface should be less than about 0.005 volume %. By operating at these low pressures or impurity concentrations, an atomically clean surface can be formed which can be passivated and altered to provide the desired surface properties either subsequent to forming the surface or concomitantly therewith.

Generally, it is desired to render the surface nonreactive with the common gases or liquids which cause surface deterioration such as air, oxygen, hydrogen sulfide, water, acids or salts; alone, in admixture or in aqueous solution. Thus, for example, when it is desired to render a metal or alloy surface nonreactive with air, oxygen, hydrogen sulfide or water, the atomically clean surface is exposed to pure nitrogen or other pure gas or liquid or mixtures thereof that do not contain gases or liquids which interact with the surface to produce undesirable properties so that the surface is protected by interaction with the pure gas or liquid. In addition, the desired surface can be obtained by sequential exposure of the atomically clean surface to two or more gases and/or liquids at the same or at different temperatures for each exposure. The atomically clean surface is exposed to the passivating agent under time and temperature conditions to assure adequate interaction of the surface therewith. The particular time and temperature will, of course, depend upon the nature of the surface, the properties desired and the passivating composition. Suitable exposure conditions range from about 250 Torr-sec. to $10^8$ Torr-sec. at temperatures between about −200° C. and 1000° C. when the passivating agent is present in sufficient amounts to attain substantially complete interaction thereof with the surface.

In a preferred aspect of this invention, metals or metal alloys which normally undergo oxidation at ambient conditions are passivated to prevent oxidation by forming an atomically clean surface thereof which is reacted with pure nitrogen to form a nitrogen-containing surface wherein the nitrogen occupies the interstitial spaces between the iron atoms. For example, it has been found that iron or iron alloys which normally undergo oxidation can be rendered immune to oxidation, i.e. "rusting", under ambient conditions even over extended time periods. In particular, a novel iron composition is provided by this invention for example by the specific procedure set forth in Example I. Normally, iron has a face-centered cubic structure (austentite) at high temperature which reforms to a body-centered cubic structure at low temperature. In nitrogen-containing alloys, an intermediate structure known as martensite is formed on cooling. Martensite is a tetragonal species which introduces defects into the material either through plastic deformation or elastic strain when the martensite is formed. In contrast, the iron composition of this invention is essentially free of martensite and face-centered cubic iron structures. The composition of this invention comprises body-centered cubic iron structures including nitrogen atoms in interstitial sites at higher concentration than $\alpha$-iron at equilibrium. This novel iron composition is highly resistant to oxidation. In order to obtain the desired oxidation resistance and minimum required concentration of the nitrogen-containing structures, the atomically clean iron must be exposed to pure nitrogen for at least about $250\times10^{-6}$ Torr-sec., preferably at least about 250 Torr-sec. at room temperature (70° F.).

The following examples illustrate the present invention and are not intended to limit the same.

EXAMPLE I

This example illustrates that iron can be passivated to prevent reaction with air at ambient conditions to form a corrosion-free surface.

In order to obtain an atomically clean surface, an ultrahigh vacuum system was used to evaporate a high purity iron film. An iron film about 12 thousand Angstroms thick was evaporated onto a solvent-cleaned and vacuum-baked iron foil substrate. Evaporation was effected by placing iron in an alumina coated tungsten wire basket at a temperature of about 1400° C. for a period of about 10 minutes. The evaporation pressure was about $5\times10^{-8}$ Torr. and the base pressure of the vacuum system was less than $1\times10^{-9}$ Torr. At a pressure of $10^{-9}$ Torr., a gas with a sticking probability of 1.0 will require ½ hour to form one monolayer on a surface. Since the evaporation occured within about 10 minutes, a maximum contaminant gas equivalent to 10 monolayers would be distributed through the deposited sample, several thousand Angstroms thick. In addition, much of the measured pressure during evaporation is due to the iron evaporant, so that even this contaminant estimate is high. Thus, the surface of the deposited iron foil is atomically clean.

After evaporation of the iron was completed, nitrogen was introduced into the system and iron evaporation was discontinued. The nitrogen gas was passed through a liquid nitrogen trap to remove residual water vapor and oxygen so that the nitrogen contacting the deposited iron was about 99.999% pure. The nitrogen contacting the atomically clean iron surface has a pressure of about 1 atmosphere and a temperature of about 20° C. Deposited atomically clean surfaces of iron were exposed to the nitrogen for various times ranging from about 1 second to about 100 hours with substantially identical results described below. In each instance, the deposited iron sample and substrate were removed from the evaporation chamber and exposed to air where the sample was peeled from the surface. The now double-sided sample has two surfaces of different composition. The entire sample is nearly identical throughout except that one side was nitrogen-treated and the opposite side was exposed to air at ambient conditions immediately upon being peeled from the substrate.

The double-sided sample was placed in a chamber of water vapor-saturated air at room temperature. The sample was examined after approximately 65 hours of exposure. Examination by electron diffraction, optical microscopy and scanning electron microscopy revealed that the nitrogen-treated side is clean and unoxidized while the side not treated with nitrogen revealed a complex iron oxide structure having red oxide blotches visible to the naked eye. When the nitrogen-treated surface was purposely broken, and exposed to water vapor, iron oxide formed on the broken exposed surface.

The procedure of this example also is applicable to treating any other metal or metal alloy or semiconductor materials such as silicon, gallium arsenide, germanium or the like or ceramics such as aluminum oxide, silicon dioxide, zirconium oxide or the like.

We claim:

1. The process for forming an iron or iron alloy surface resistant to oxidation over extended periods which comprises forming an atomically clean surface of iron or an iron alloy in an environment selected from the group consisting of nitrogen, an inert gas and a vacuum free of a gas or liquid which is deteriously reactive with said iron or iron alloy and when forming said atomically clean surface in an environment of said inert gas or said vacuum, subsequently exposing said atomically clean surface to nitrogen to form a surface stable against degradation by oxidation prior to exposing said surface to oxygen.

2. The process of claim 1 wherein the iron or iron alloy is formed in an environment of inert gas.

3. The process of claim 1 wherein the iron or iron alloy is formed in an environment of a vacuum essentially free of a gas or liquid which interacts with said iron or iron alloy.

4. The process of claim 1 wherein the atomically clean surface is formed in an environment of nitrogen.

5. An oxidation-resistant iron surface comprising iron structure including nitrogen atoms interstitially, said surface being essentially free of face-centered cubic iron structures and martensite iron structures, said composition being formed by exposing a surface of atomically clean iron to pure nitrogen for at least about $250\times10^{-6}$ Torr-sec. at 70° F.

* * * * *